US008100073B2

(12) United States Patent
Waldhauser et al.

(10) Patent No.: US 8,100,073 B2
(45) Date of Patent: Jan. 24, 2012

(54) COUPLING AND DECOUPLING METHOD AND DEVICE FOR IN-BOOM FURLING BOOM SAILS

(76) Inventors: Kurt Waldhauser, Stattegg (AT); Volker Waldhauser, Gratkorn (AT)

( * ) Notice: Subject to any disclaimer, the term of this patent is extended or adjusted under 35 U.S.C. 154(b) by 0 days.

(21) Appl. No.: 12/738,215

(22) PCT Filed: Oct. 10, 2008

(86) PCT No.: PCT/AT2008/000369

§ 371 (c)(1),
(2), (4) Date: Aug. 16, 2010

(87) PCT Pub. No.: WO2009/049339

PCT Pub. Date: Apr. 23, 2009

(65) Prior Publication Data

US 2010/0319600 A1 Dec. 23, 2010

(30) Foreign Application Priority Data

Oct. 16, 2007 (AT) ..... A 1655/2007

(51) Int. Cl.
*B63H 9/04* (2006.01)

(52) U.S. Cl. ..... 114/106; 114/108

(58) Field of Classification Search ..... 114/104, 114/105, 108, 112, 114, 106

See application file for complete search history.

(56) References Cited

U.S. PATENT DOCUMENTS

| | | | | |
|---|---|---|---|---|
| 1,650,759 | A * | 11/1927 | Larsen | 114/98 |
| 1,798,772 | A | 3/1931 | Wood | |
| 3,830,182 | A | 8/1974 | Pattison | |
| 4,077,347 | A * | 3/1978 | Arce | 114/108 |
| 5,697,314 | A * | 12/1997 | Clausin | 114/106 |
| 6,371,037 | B1 | 4/2002 | Cook et al. | |
| 6,539,885 | B2 * | 4/2003 | Tylaska | 114/108 |
| 2004/0079269 | A1 * | 4/2004 | Cudd et al. | 114/105 |

* cited by examiner

*Primary Examiner* — Stephen Avila
(74) *Attorney, Agent, or Firm* — Greer, Burns & Crain, Ltd.

(57) ABSTRACT

The invention relates to a method for automatically coupling and decoupling the luff of a battened mainsail and stackable luff holders as the connecting link between the sail luff and mast guiding slides, thereby allowing the now free sail luff to be reefed up by means of an in-boom furling boom and allowing the battened mainsail to be hoisted and reefed by means of mast guiding slides.

9 Claims, 2 Drawing Sheets

Fig. 1
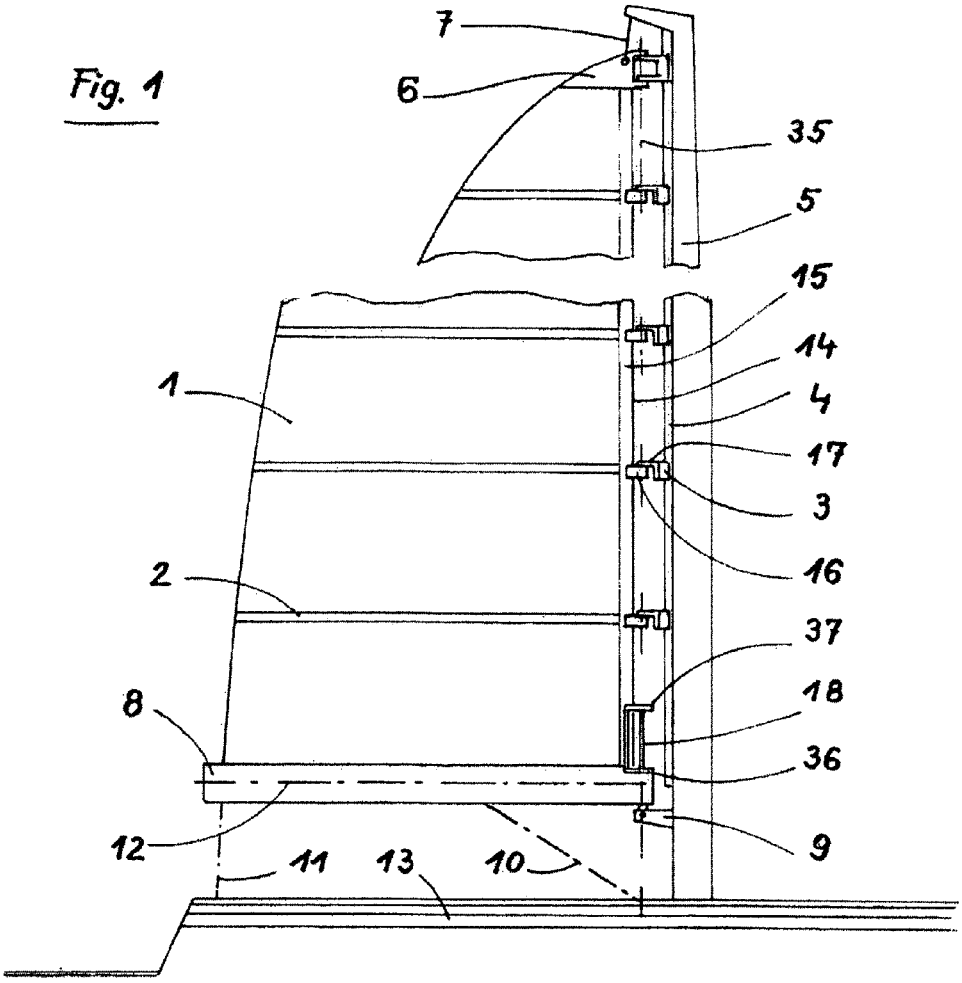
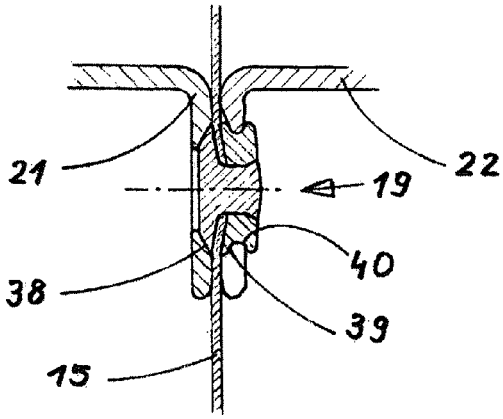
Fig. 5

COUPLING AND DECOUPLING METHOD AND DEVICE FOR IN-BOOM FURLING BOOM SAILS

BACKGROUND OF THE INVENTION

The invention relates to an automated coupling and decoupling method between the luff of a sail and mast guiding slides when hoisting and furling a battened mainsail, and a device for performing this method.

In-boom roller furling systems of greatly varying constructions wind the foot of a sail over an approximately horizontally rotatable winding mandrel for reefing in the case of strong wind and thus reduce the sail area to an amount supportable by the ship or roll it away entirely for furling.

The advantage of boom roller furling systems in relation to other systems is that through-battened mainsails having advantageous leech presentation may be used having almost equally good position and performance as in the case of sails having a traditional jiffy reef.

In the case of regatta participants, where performance is important, typically only sails having jiffy reef come into consideration at all, whose approximately horizontal continuous sail battens may be hoisted and/or furled using smooth-running running slides guided on the rear edge of the mast. For reefing, the lower part of the sail is pulled down in folds and bound to the boom using chords, which are typically attached to the sail, by a strong regatta crew. For a small crew, who wants to sail safely and efficiently, only an in-boom furling system comes into consideration because of the better sail position, in spite of its flaws, properties, and known problems.

The main problem is the luff of the sail and its connection to the mast. It is to let the sail run up and down in a smooth-running manner and the luff is to be able to be wound over the winding mandrel jointly with the sail.

Currently, a luff tape made of fabric plastic having correspondingly smaller terminal diameter, in order to be windable, is selected, which is longitudinally displaceable within a special small mast groove, but cannot slip through it.

The winding diameter of the coiled luff tape cannot significantly exceed the diameter of the sailcloth bale, including profile reinforcements, when reefing and furling, because both must be wound on the same mandrel as free of wrinkles as possible. So as not to be entirely filigree in construction, the luff tape is often sewn along its length of the sail in a slightly wavy form, so that the luff winding occurs not only one on top of another, but rather more widely one next to another, with the disadvantage of greater friction in the mast groove, which runs linearly and accordingly warps the sail.

In order to connect the advantageous sail guiding along a tall mast to smooth-running running slides of a battened mainsail as for a jiffy reef, for example, and the operating advantages of an in-boom furling system, the following solution is proposed according to the invention.

Patents which represent the prior art:

U.S. Pat. No. 3,830,182 A (PATTISON) 20 Aug. 1974 (20.08.1974)

U.S. Pat. No. 1,798,772 A (WOOD) 31 Mar. 1931 (31.03.1931)

U.S. Pat. No. 6,371,037 B1 (COOK ET AL) 16 Apr. 2002 (16.04.2002)

SUMMARY OF THE INVENTION

The goal of the invention was to provide an automatic coupling and decoupling system of the sail luff, which allows a preferred battened mainsail in suitable shape and quality, which is hardly restricted in height, having continuous sail battens parallel to the foot in a suitable number, on the one hand, to be hoisted or reefed along the mast in a typical way using smooth-running mast guiding slides behind a mast in a suitable running track and, on the other hand, to advantageously hoist and furl the sail through a coupling method according to the invention via a device using the luff, which is then released, advantageously using an easily operable roller furling boom.

Because setting and furling sail always occurs in the direction against the wind, the roller furling boom always occupies the location behind the mast, so that this position is decisive for the overall function.

In the mast-side attachment of the sail, a luff holder implemented according to the invention, made of hard aluminum and/or stainless steel, is preferably located in front of each sail batten, which is in turn mounted so it is horizontally pivotable on a suitable mast guiding slide (mast roller), so that pivoting outward of the sail to both sides is provided. The luff holder allows a disconnection of the luff of the battened mainsail from the components of the mast-side guiding path just before it is wound onto the winding mandrel of the roller furling boom. The sail can thus be rolled up in its entirety unobstructed, while in contrast the guide path elements, i.e., luff holders and mast guiding slides, remain stacked closely on one another at the end of the mast guiding path. The luff holders are concealed in a stacking magazine for protection against contact, which is fastened on the roller furling boom on the mast side and in which all switching functions of the coupling and decoupling occur in mutual cooperation. The energy required for this purpose is taken from the upward and downward movement of the sail.

Upon further hoisting of the sail, each sail batten which was wound up picks up its associated mast guiding slide again using the luff holder according to the invention and thus again produces an inseparable connection along the mast. If needed, in a similar way, an additional luff holder having mast guiding slides can be placed between the battens.

The coupling and decoupling of the sail/mast guiding slide connection occurs according to the invention through a forced function of the luff holder, which does not permit any incorrect switching in the functional sequences due to its mechanical construction and thus operates reliably.

The luff of the battened mainsail does not have a sewn-in round luff cord as is typical, but rather a high-strength thin luff belt according to the invention, in which button rivets formed for docking the luff holder are each preferably riveted in fixedly in front of the sail battens, which produce a positive permanent connection on all sides enclosed by the lever closure of the luff holder.

Each luff holder according to the invention comprises a molded base plate having a fixed jaw protruding approximately perpendicularly, which has a corresponding conical recess to receive the button rivets of the belt as the sail luff. A molded closure jaw is located parallel to the fixed jaw and spaced apart from the luff belt to be clamped, whose opening rotational axis is received in a bearing bush, which is fixedly connected to the base plate.

The opening geometry of the closure jaw in the form of a higher point of rotation allows a free passage of the luff belt from top to bottom when reefing. Vice versa, the easy-closing spring-loaded jaw capture an unrolled incoming button rivet using their leading detent arms, center it, and enclose it in the fixing depressions, so that upon hoisting of the sail, the connection closure (luff holder) is carried upward along the mast together with its coupled mast guiding slide.

Before each coupled luff holder leaves the stacking magazine, mechanical forced locking of the two clamping jaws is performed by lever contact, so that all slides going up the mast are inseparably coupled to the sail. This coupling is first disengaged when the first luff holder arrives at the base of the stacking magazine upon furling or when a further luff holder is placed in the final position on the prior one. I. e., the coupling and decoupling procedures occur exclusively within the stacking magazine immediately before and after the sail is wound up. However high the sail is hoisted, it is always attached fixedly and non-positively.

The components of the luff holder are implemented in order to be closely stackable so that they spatially interlock vertically in one another using their functional elements and may thus acquire their multifunction. Thus, upon furling of the sail, the luff holder running into the prior luff holder from above opens its forced locking of the closure jaws in each case, which then releases the fixed luff holder of the sail for rolling up. Simultaneously, however, a spacer finger protruding downward from the upper base plate is pushed into the lower luff holder, which entirely raises and disengages the already unlocked, slightly spring-loaded closure jaws there against the spring force.

All of the other luff holders located underneath in the case of furled, i.e., rolled-up sail, thus each have an entirely raised closure jaw in the stacking magazine, which are each raised by the upper spacer finger and covered thereby in such a manner that they all remain in the stack outside the range of the button rivets of the luff holder and these rivets may pass freely during the up or down movement.

The closure jaw of the particular uppermost luff holder, in contrast, is not raised because the next one located above is missing, and therefore presses against the luff belt with light spring force. If the luff belt is unrolled and drawn upward when shaking out the sail and when setting sail, each arriving button rivet only takes along the particular uppermost luff holder, locks it upon exit from the stacking magazine to form a fixed connection using an eccentric lever of the forced locking unit pivoted beyond dead center and runs up the mast guided by the mast guiding slide. When furling the sail, the individual functional steps run in reverse, up to the unlocking moment of the forced locking unit, which occurs in each case entirely at the path end before running into the stack height in the stacking magazine.

All luff holders run into the stacking magazine conducted by the guiding slides. The first, which has arrived lowermost on the magazine floor here, opens the closure jaw by pivoting the protruding control lever of the forced locking unit by running into the stop of the stacking magazine, so that the now released sail can be rolled away and the next incoming luff holder runs into the first. Through the mutual running into the particular one below, firstly the closure jaw therein is disengaged by the spacer finger and the forced locking unit of the oncoming luff holder is opened by adapted lever contact with the lower slightly later in the same stroke, whereby the luff is finally released as a whole and the sail as a whole can be rolled up until the headboard of the sail has been drawn to the stacking magazine.

The above description outlines the more important features of the present disclosure rather broadly, so that the more detailed description which follows contains additional features of the disclosure and is thus better understandable.

The embodiments of the disclosure are not restricted to the details of the design situated in the following description and in the detail drawings. Other embodiments may be practiced in the scope of the invention and implemented in various ways. In addition, it is obvious that the phraseology and terminology used is only employed for description and not as a restriction.

Exemplary embodiments of the invention are explained in greater detail hereafter on the basis of the drawings.

BRIEF DESCRIPTION OF THE DRAWINGS

FIG. 1 shows a battened mainsail guided by roller slides having roller furling boom on a ship;

FIG. 5 shows the cross-section of a button rivet 19;

DETAILED DESCRIPTION OF THE PREFERRED EMBODIMENTS

Figures 2, 3, 4:
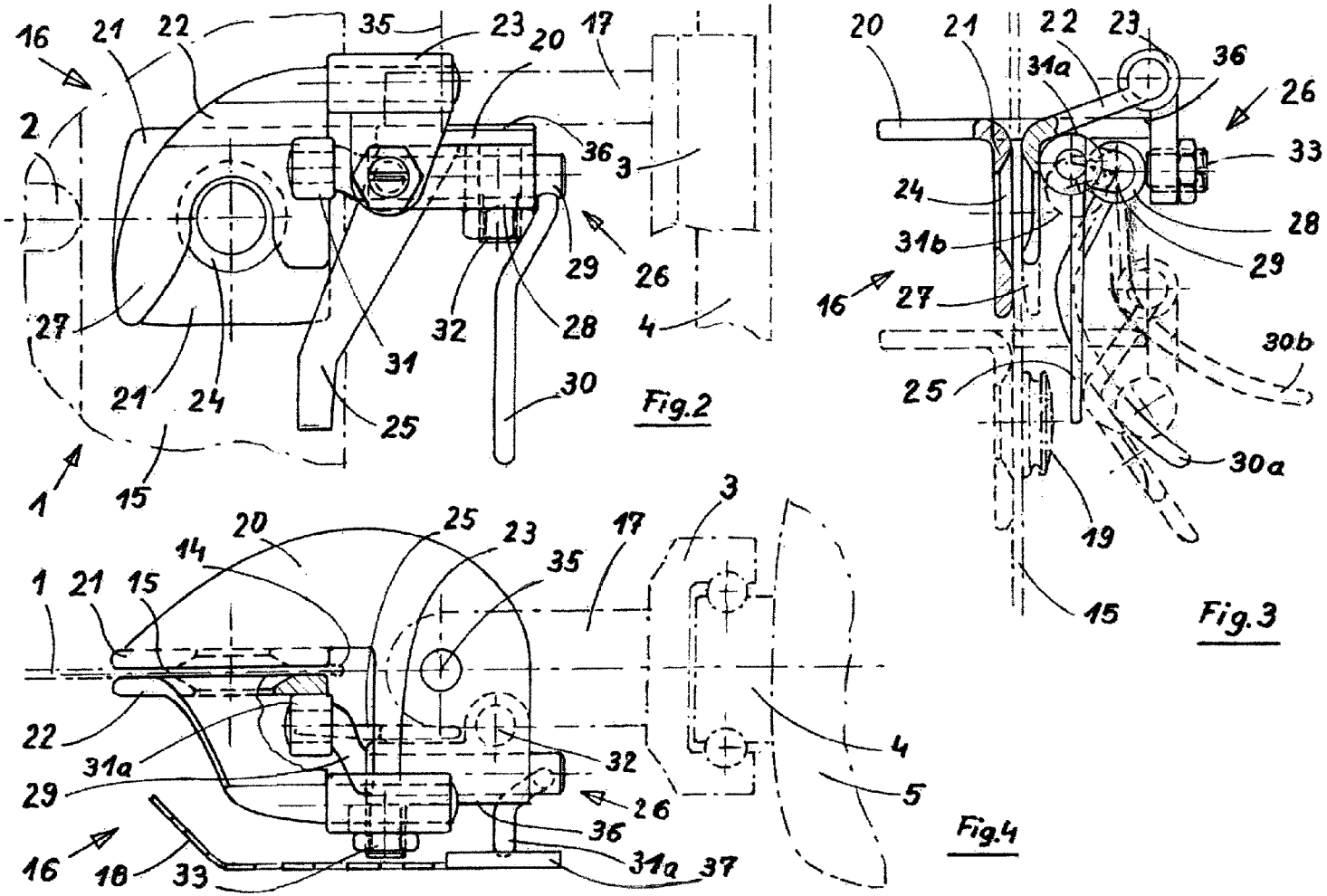
FIG. 2 is the view of a luff holder 16 according to the invention.
FIG. 3 is the side view of the luff holder 16.
FIG. 4 shows the top view of the luff holder 16.

FIG. 1 shows a ship 13, on which a mast 5 stands, on which a roller furling boom 8 is mounted so it is pivotable to all sides using a gooseneck 9 and is held in position in a typical manner using a boom support 10 and a main sheet 11.

Furthermore, a battened mainsail 1 is shown, which has been raised and/or hoisted entirely on the mast 5 using a main halyard 7 on a headboard 6.

The battened mainsail 1 is uncoiled for this purpose from a winding mandrel 12 (shown by dot-dash lines as a center line) of a roller furling boom 8. The sail battens 2 are all situated in a suitable number parallel to the winding mandrel 12 and are thus windable over it.

The luff 14 of the sail 1 must also be windable in such a way that its growing cross-sectional coil diameter always remains equal to that of the sail 1 including its sail battens 2, which is performed according to the invention using a suitable belt strap as the luff belt 15.

The force transmission from the sail 1 to the mast 5 advantageously occurs in each case in front of the sail battens 2 via a luff holder 16 according to the invention, which is guided on a mast guiding slide 3 along the mast guiding path 4 and allows smooth-running hoisting and furling of even a large sail, above all a tall sail.

Dimensionally-rigid connecting links 17 made of suitable material are required between the luff holders 16 and the possibly commercially-available guiding slides 3, which allow mechanical adaptation to dimensional differences and ensure a parallel guide along the guide rail 4 and allow linked horizontal pivoting of the luff holders 16 to both sides, as required by the use of the sail 1. The pivot rotation points 35 of the luff holders 16 must lie above that of the gooseneck 9 for this purpose in the longitudinal direction of the mast.

The reefing and furling of the sail 1 is performed by rolling it up on the winding mandrel 12 of the roller furling boom 8, the luff holder 16 located at least in front of each sail batten 2 arriving in the stacking magazine 18, which is located above the gooseneck 9, fastened on the roller furling boom 8.

Coming to the base of the stacking magazine 18, the first luff holder 16 mechanically unlocks using its forced locking unit 26 (in FIG. 2) and releases the luff belt 15 to be rolled up, the unlocked luff holder 16 remaining in the stacking magazine 18. The connection link 17, which is attached so it is horizontally pivotable, and which represents the mechanical connection to the mast guiding slide 3, remains attached to the mast guiding path 4 on the mast side.

All luff holders 16 are stackable in their structure and partially perform their coupling function with the aid of stops of the stacking magazine 18, all switching functions occurring within the protection and the guide of this magazine body.

The view of a luff holder 16 according to the invention is shown in FIG. 2, coupled to a luff belt 15 according to the invention of a sail 1 having a riveted-in button rivet 19 (in FIGS. 3 and 5) in front of a sail batten 2 (shown by dot-dash lines).

A possible mast guiding path 4 having a smooth-running mast guiding slide 3, from which a dimensionally-rigid connection link 17 extends to the laterally pivotable base plate 20 in an adapted manner, is shown by dot-dash lines. The contour of the fixed jaw 21 can be seen, in the foreground the closure jaw 22 having the leading detent arms 27 having their bearing bush 23 and the spacer finger 25 protruding downward from the base plate 20, furthermore the rotational axis of the forced locking unit 26 running approximately parallel to the bearing bush 23, which keeps the closure jaw 22 permanently locked in the closed state outside the stacking magazine 18 (in FIG. 1).

FIG. 3 is the side view of FIG. 2 of the luff holder 16 from the side of the sail 1 according to the invention. The mechanical structure can be seen, comprising a base plate 20 having a fixed jaw 21 protruding approximately perpendicularly and a molded closure jaw 22, which is linked in relation to the fixed jaw 21 in such a manner that the opening of the two occurs with the movement of the luff belt 15 running downward and the release of the button rivets 19 occurs by the free pivoting out over the lateral and higher-lying bearing bush 23, which runs in the horizontal approximately parallel to the luff belt 15 and is fastened on the base plate 20.

Both the fixed jaw 21 and also the closure jaw 22 have an exposed conical recess 24 provided in the clamping jaws in the closed state with appropriate clamping pressure on the luff belt 15, the recess enclosing the incoming button rivets 19 positively therein and thus an unshakable coupling resulting.

Furthermore, the mechanism and function of the forced locking unit 26 in the closed locked position can be seen, which comprises an eccentric axis 29 running in a bearing bush 28, which is pivoted using the attached switching lever 30 (in FIG. 2) into the locked position 30*a* and, using the attached contact pressure cog 31 (in FIG. 2) on the eccentric arm, pivots the eccentric axis 29 via its dead center into the locked position 31*a*, and locks the closure jaw 22 to clamp the luff belt 15. In order to be able to set the pressure on the luff belt 15 to various makes of the luff belt, the forced locking unit 26 is linked as a complete component via the fastening bolts having nuts 32 (in FIGS. 2 and 4) and can be moved toward the closure jaw 22 using the adjustment screw 33, which can be countered, and is thus re-adjustable.

The unlocking of the closure jaw 22 can only be performed when a luff holder 16 runs into the one located underneath in the stacking magazine 18 (in FIG. 1), so that upon the approach, the switching lever 30 (in FIG. 2) located in the locked position 30*a* receives contact with the switching link 36 located underneath and the unlocking procedure is completed shortly before reaching the stack height and the unlocked position 30*b* of the switching lever 30 (in FIG. 2) and the contact pressure cog 31 (in FIG. 2) is in the unlocked position 31*b*.

Furthermore, the spacer finger 25 protruding downward is shown, as it engages in a luff holder 16 (shown by dot-dash lines) located underneath in the stack and entirely raises the previously unlocked closure jaw 22, so that a button rivet 19 incoming from below or protruding downward does not find an engagement point and can pass freely, as well as in the case of all luff holders 16 located underneath in the stack.

Every button rivet 19 coming upward upon unrolling thus passes all luff holders 16 located in the stacking magazine 18 (in FIG. 1) unobstructed and catches in the leading centering detent arms 27 of the easy-closing spring-loaded closure jaw 22 of the particular uppermost luff holder 16, whose contact pressure cog 31 (in FIG. 2) is in the unlocked position 31*b* and takes it along on its route up the mast 5 (in FIG. 1).

FIG. 4 shows the top view of a luff holder 16 according to the invention in the closed state having coupled sail 1 (shown by dot-dash lines) behind a typical mast 5 having a mast guiding path 4, a mast guiding slide 3, and a connection link 17 (shown by dot-dash lines) adapted to the mutual connection dimensions.

Possible shaping of the base plate 20, the pivot rotation point 35, around which the luff holder 16 is mounted so it is pivotable horizontally on both sides, which is positioned aligned with the sail 1 and as close as possible to its luff 14, are shown. The closure jaw 22, which closes approximately parallel to the fixed jaw 21, having its bearing bush 23, which also runs parallel, and which is fastened on the base plate 20, are shown. Furthermore, the switching link 36 can be seen as the external contour of the base plate 20, on which the forced locking unit 26 of a luff holder 16 running into it from above unlocks.

The forced locking unit 26 (partially shown by dot-dash lines) is located below the base plate 20, whose bearing bush 28 (in FIG. 3), which also runs approximately parallel, is fixed by the fastening bolts having nuts 32, which can be guided toward the closure jaw 22 using the adjustment screw 33, which can be countered and is offset laterally and by 90°, in order to set the closing pressure of the contact pressure cog 31 (in FIG. 2) in the locked position 31*a*.

The opening moment of the forced locking 26 is determined by the shape and position of the switching lever 30 (in FIG. 2), which, shortly before the upper luff holder 16 runs into the lower, pivots the eccentric axis 29 by contact with the switching link 36 of the lower enough that the contact pressure cog 31 (in FIG. 2), which is brought into the unlocked position 31*b* (in FIG. 3) via the dead center, opens the closure jaw 22 enough that the enclosed button rivet 19 of the luff belt 15 can slide out of the exposed conical recess 24 (in FIG. 2) of the jaws 21 and 22 and releases the sail 1 to be rolled in.

The moment of the locking of the fixed jaw 21 using the closure jaw 22, which is pressed against it by light spring force, when setting the sail 1 occurs exclusively upon exiting of the luff holders 16, which are acquired by the button rivets 19 and raised, from the stacking magazine 18 (in FIG. 1) through an exit baffle 37 on its upper end, which pivots the switching lever 30 (in FIG. 2) from the unlocked position 30*b* (in FIG. 3) of the forced locking 26 downward into the locked position 31*a* and thus moves the contact pressure cog 31 (in FIG. 2) of the eccentric axis 29 from the unlocked position 31*b* (in FIG. 3) in front of the dead center into the locked position 31*a* via the dead center and thus positively confines all button rivets 19 (in FIG. 3) of the sail 1 between the jaws 21 and 22 in their exposed conical recess 24 (in FIG. 3).

FIG. 5 shows the cross-section of a lathed button rivet 19 riveted into the luff belt 15 of the sail 1 (in FIG. 1), preferably made of aluminum or stainless steel, which has a conical outer contour 38 like a truncated cone adapted to its exposed recess in the area of the fixed jaw 21, which can be positively fixed in the conical recess 24 (in FIG. 3) in the case of sustained clamping pressure, but can slide out of it without clamping pressure.

An approximately mirror-inverted conical lathed area 39 is provided to transmit the contact pressure in the area of the closure jaw 22, but toward the outer end it becomes a detent groove having a rounded outer shoulder 40, using which the button rivet 19 can slide from the closure jaw 22 lightly pressing against it upon hoisting into its conical recess 24 (in FIG. 3) and can be securely captured.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The invention claimed is:

1. A coupling and decoupling device for a sail of a ship which is equipped with a roller furling boom, the sail having a luff which is hoisted and furled using smooth-running mast guiding slides along a mast guiding path on a rear side of a mast, comprising:

luff holders provided as binding links between button rivets of a luff of the sail, which are folded over in a luff belt, and mast guiding slides, each luff holder comprising a horizontal base plate, which is mounted so it is horizontally pivotable to both sides on a connection link of a provided mast guiding slide, and having a fixed jaw protruding perpendicularly downward and an easy-closing spring-loaded opposing closure jaw, to fix the button rivets, an opening rotational axis of the jaws, which is parallel to the base plate, being received in a jaw bearing bush lying above the base plate, the jaw bearing bush being fixedly connected to the base plate and having an opening geometry parallel to the luff belt guided in between the jaws, a forced locking unit being provided for the fixed closure of the two jaws to one another, which locking unit comprises an eccentric axis having a contact pressure cog on an eccentric stub, mounted in a locking unit bearing bush, which is fixed so it is pivotable parallel to the jaw bearing bush under the base plate around a fastening bolt having a nut, and a spacer finger protruding downward from each base plate of the luff holder for spacing apart the closure jaw from the fixed jaw of the particular luff holder underneath upon reefing of the sail.

2. The coupling and decoupling device according to claim 1, wherein a stacking magazine is provided which is fastenable on the roller furling boom for guiding the luff holders to be received in mutual switching position one on top of another, a bottom stop of the magazine comprising a switching link for engagement by a switching lever of the forced locking unit, each base plate of the luff holder also comprising a switching link for engagement by the switching lever, an exit baffle being provided in front of an uppermost exit end of the magazine as a stop for the switching lever of the forced locking unit for locking the closure jaw as the luff holders move upwardly out of the magazine.

3. The coupling and decoupling device according to claim 1, wherein the button rivets folded into the luff belt of the sail have a conical outer contour in the shape of a truncated cone on the side of the fixed jaw and have a mirror-inverted conical area on the engagement side of the closure jaw, as well as a detent groove with a rounded outer shoulder.

4. The coupling and decoupling device according to claim 1, wherein both jaws have a mirror-inverted conical recess adapted for receiving the button rivets, and centering detent arms which lead downward protruding from the conical recess of the closure jaw.

5. The coupling and decoupling device according to claim 1, wherein the sail includes a plurality of battens and a button rivet is folded over in the luff belt in front of each sail batten.

6. A coupling and decoupling method for a sail of a ship which is equipped with a roller furling boom, a luff of the sail being hoisted and furled using smooth-running mast guiding slides along a mast guiding path on a rear side of a mast, comprising the steps of:

clamping a luff belt of the sail to be fixed between a fixed jaw and a closure jaw and enclosing button rivets folded over in the luff belt by depressions in the clamped jaws, pressing a switching lever attached to an outer end of an eccentric axis downward into a locked position via a dead center position, pressing a contact pressure cog from an unlocked position into a locked position by a contact with an exit baffle of a stacking magazine upon hoisting the sail, during a furling procedure, releasing the button rivets in the luff belt of the sail before rolling the sail up in the roller furling boom, by having a closure jaw of the first luff holder arriving at a bottom of a stacking magazine pushing a forced locking unit of the luff holder from a locked position of the switching lever into an unlocked position through a switching link on a bottom stop of the stacking magazine, mechanically contacting the switching lever of the forced locking unit against a switching link of a luff holder located underneath a descending luff holder to open the closure jaw of the descending luff holders to be stacked on top of the first luff holder, bringing a contact pressure cog from a locked position via a dead center position into an unlocked position by pivoting an eccentric axis, and raising the closure jaw by a spacer finger, which is unlocked in this position, out of engagement with the particular luff holder located underneath in the stack.

7. The coupling and decoupling method according to claim 6, wherein during the furling procedure of the sail, providing a free passage of the luff belt with the folded-in button rivets between the fixed jaw and the opposing closure jaw of the particular uppermost luff holder, but in the opposite, hoisting direction, catching and fixing the button rivets using the detent arms of the closure jaw.

8. The coupling and decoupling method according to claim 6, wherein the decoupling function of the luff holders from the button rivets in the luff belt of the sail occurs through the downward movement upon reefing of the sail in the approach phase of the luff holders to one another and is terminated shortly before their stack height in the stacking magazine, the coupling functions of the luff holders on the button rivets in the luff belt of the sail being performed through the upward movement upon hoisting of the sail and being terminated before exit of the coupled luff holders from the stacking magazine.

9. The coupling and decoupling method according to claim 6, wherein the closing pressure of the contact pressure cog, which is brought via the dead center position from the unlocked position, is settable by a countered adjustment screw.

* * * * *